United States Patent [19]

Nakada

[11] 4,411,582

[45] Oct. 25, 1983

[54] ELECTRONICALLY CONTROLLED INDUSTRIAL TRUCKS

[75] Inventor: Shoichi Nakada, Matsudo, Japan

[73] Assignee: Komatsu Forklift Kabushiki Kaisha, Tokyo, Japan

[21] Appl. No.: 236,191

[22] Filed: Feb. 20, 1981

[30] Foreign Application Priority Data

Aug. 20, 1979 [JP] Japan ..... 54-104974

[51] Int. Cl.[3] ..... B66F 9/06; B66C 13/16; B66B 1/24

[52] U.S. Cl. ..... 414/636; 187/9 R

[58] Field of Search ..... 414/629, 635, 636, 641, 414/674; 187/9 R, 9 E

[56] References Cited

U.S. PATENT DOCUMENTS 3,319,816 5/1967 Christensen ..... 187/9 E X

FOREIGN PATENT DOCUMENTS 52-53584 4/1977 Japan .
52-53585 4/1977 Japan .
52-66260 6/1977 Japan .

*Primary Examiner*—Robert G. Sheridan
*Attorney, Agent, or Firm*—Armstrong, Nikaido, Marmelstein & Kubovcik

[57] ABSTRACT

An electronically controlled fork-lift truck having a tilt-cylinder controlled mast and a lift-cylinder controlled fork, comprising a control board mounted adjacent to a driver's seat, the control board having formed thereon various push button switches and a display panel for displaying the heights of the fork, an electronic controller operatively connected with the control board for controlling the movements of the fork and mast, a fork height sensor for detecting the movement of the fork and generating signals denoting increments of that movement, and a tilt sensor for detecting the upright and a tilt-back position of the mast and providing a signal to stop the mast movement wherein the electronic controller can provide various functions including an automatic fork raising and lowering operation.

8 Claims, 13 Drawing Figures

ELECTRONICALLY CONTROLLED INDUSTRIAL TRUCKS

BACKGROUND OF THE INVENTION

This invention relates to industrial trucks, such as fork-lift trucks or the like in which it is desirable to control automatically the extent of an auxiliary movement such as the height to which a load is raised.

Conventionally, a fork-lift truck is generally equipped with control levers positioned adjacent to the operator's seat so as to control the height of a fork and/or the tilt angle of a mast thereby. Therefore it requires a great skill to correctly raise the fork to a preselected desirable position by the manipulation of the control levers.

This is especially so when the operator must raise the fork to a high level in order to move loads positioned on a high rack because it is difficult for the operator to see the tip of the fork when it is raised. Since the operator is continuously under severe stress when working, he would likely to be fatigued early and working efficiency would be reduced significantly.

There have been known some fork-lift trucks in which the lifting operation of the fork is controlled by pushing buttons arranged adjacent to the operator's seat instead of manipulating control levers. Most of these prior art devices, however, are not sophisticated enough to effect precise controls of the fork.

SUMMARY OF THE INVENTION

It is therefore an object of the present invention to provide an electronic controller which is sophisticated enough to control various movements of a fork and a mast of a fork-lift truck.

Another object of the present invention is to provide a fork-lift truck wherein movements of a fork and a mast of the truck are electronically controlled without manipulating any control levers.

A further object of the present invention is to provide a fork-lift truck which requires little skill for correctly raising a fork to a desired level thus minimizing fatigue of an operator.

In accordance with an aspect of the present invention, there is provided an electronic controller for controlling movements of a fork and a mast of a fork-lift truck wherein the movement of the fork is effected by a lifting mechanism and that of the mast is effected by a tilting mechanism, comprising: first sensor means for detecting the movement of the fork and providing first signals denoting increments of that movement; counter means for receiving said first signals and providing a count denoting the height of the fork along its range of movement; memory means for storing data each denoting the height of the fork and providing one of said stored data for comparison with said count; means for effecting storage in said memory means; first comparator means for comparing said count with a representation made available from said memory means to provide a second signal for controlling the movement of the fork; first actuator means adapted to receive said second signal and actuate said lifting mechanism thereby; second sensor means for detecting an upright and a tilt-back position of the mast and providing a third signal to stop the mast movement; second actuator means for actuating said tilt mechanism, said second actuator means being adapted to receive said third signal and silenced thereby; and a control board including various switches for starting and stopping the movements of the fork and the mast, said control board being operable by a human operator to provide for the storage of said count in storage location of which the address is determined by the operation of a particular switch and in which the memory is addressable on subsequent operation of said particular switch to make the stored count available for the comparison.

Another aspect of the present invention is to provide a fork-lift truck including a truck body, a driver's seat, a mast pivotally mounted on the truck body, a tilt cylinder for effecting tilt movement of the mast, a fork mounted on the mast, and a lift cylinder for effecting up and down movements of the fork, comprising: a control board mounted adjacent to said driver's seat, said control board having formed thereon various push button switches for controlling the movements of said fork and mast, and a display panel for displaying heights of said fork; electronic controller means operatively connected with said control board for controlling the movements of said fork and mast; fork height sensor means for detecting the movement of said fork and generating first signals denoting increments of that movement, said fork height sensor means being operatively connected with said electronic controller means; tilt sensor means mounted on said truck body for detecting an upright and a tilt-back position of said mast and providing a second signal to stop the mast movement; first actuator means for actuating said lift cylinder, said first actuator means being connected with and controlled by said electronic controller means; and second actuator means for actuating said tilt cylinder, said second actuator being silenced by receiving said second signal from said tilt sensor means.

The above and other objects, features and advantages of the present invention will be readily apparent from the following description taken in conjunction with the accompanying drawings.

DETAILED DESCRIPTION OF THE PREFERRED EMBODIMENTS

The present invention will now be described in detail with reference to the accompanying drawings.

Figure 1:
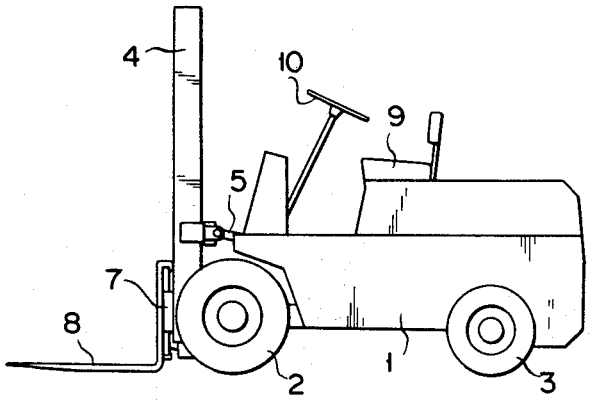
FIG. 1 is a side elevational view of a fork-lift truck according to the present invention.

Referring first to FIG. 1, reference numeral 1 denotes a body of a fork-lift truck mounted on front and rear wheels 2 and 3. Mounted on a front part of the body 1 is a mast 4 which is pivoted forwardly or backwardly by the action of a tilt cylinder 5.

Pivoted in front of the mast 4 and moved up and down by the action of a lift cylinder 6 through a drive chain (not shown) is a finger board 7 to which a fork 8 is mounted.

A driver's seat 9 is mounted on the body 1 and a steering wheel 10 is arranged in front of the driver's seat 9.

Figure 3:
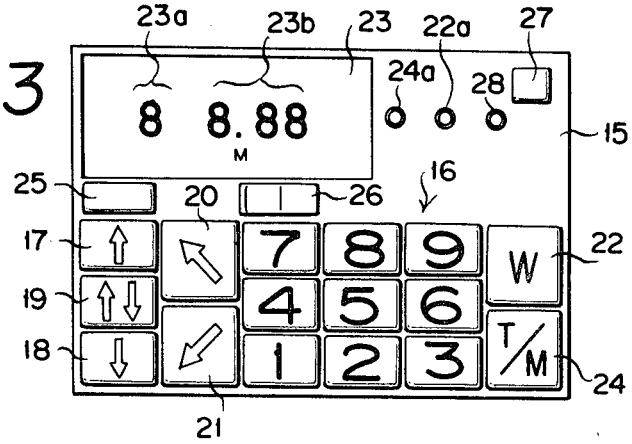
FIG. 3 is a plan view of a control board showing the arrangements of various switches and a display panel.

Arranged underneath the steering wheel 10 are a clutch pedal 11, a brake pedal 12 and an accelerator pedal 13. A shift lever 14 is also provided for changing the gear ratio of a transmission and forward and reverse changeover of the truck. Reference numeral 15 denotes a control board in which an electronic controller for controlling the movements of the mast 4 and fork 8 is housed. The control board 15 has formed thereon a plurality of push button switches and a display panel as shown in FIG. 3. The control board of FIG. 3 includes a push button address switch group 16, comprising a plurality of push button switches numbered from 1 to 9, for setting the height of the fork 8, push button switches 17 and 18 for raising or lowering the fork 8, a push button switch 19 for automatically raising or lowering the fork 8 to a preset and memorized height, push button switches 20 and 21 for tilting the mast 4 forwardly or backwardly, a push button switch 22 for storing the preselected height of the fork 8 in a memory circuit of the electronic controller which will be explained later, and a display panel 23 which is divided into two sections 23*a* and 23*b*.

The section 23*a* displays the selected push button number along the push button switch group 16 and the section 23*b* displays the height of the fork 8 in meters. The control board 15 further includes a push button switch 24 for changing the data displayed in the display panel 23, a push button switch 25 for commanding the fork-lift truck to take normal running posture, a push button switch 26 for high and low speeds changeover, an emergency stop button switch 27 for stopping the prime mover of the truck in case of emergency, indicator lamps 22*a* and 24*a* for indicating the switches 22 and 24 being pushed on, respectively, and an indicator lamp 28 for monitoring the battery for the electronic controller. All of these switches, display panel and indicators are connected to the electronic controller which will be later explained in detail.

Figure 4:
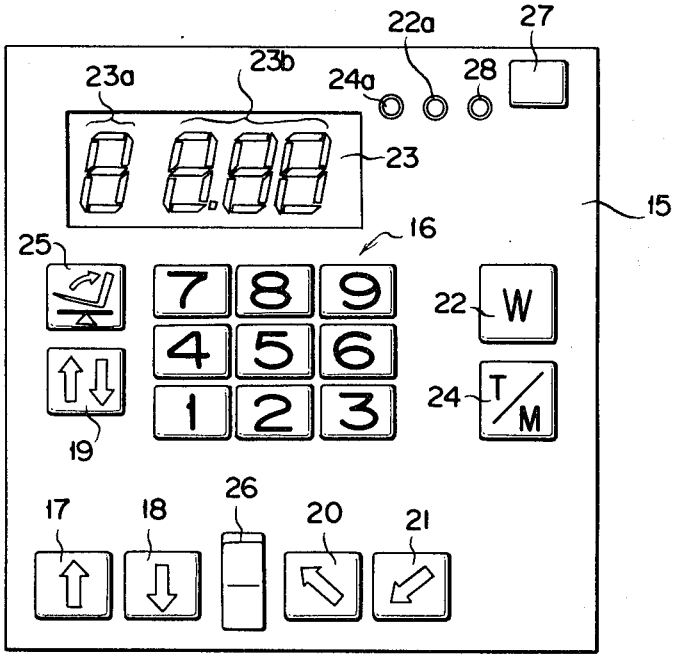
FIG. 4 is similar to FIG. 3 but showing another arrangements of a control board.

FIG. 3 shows one example of the layout or arrangement of the various switches and of course it is possible to provide many modifications thereof, one of which is shown in FIG. 4.

Figure 2:
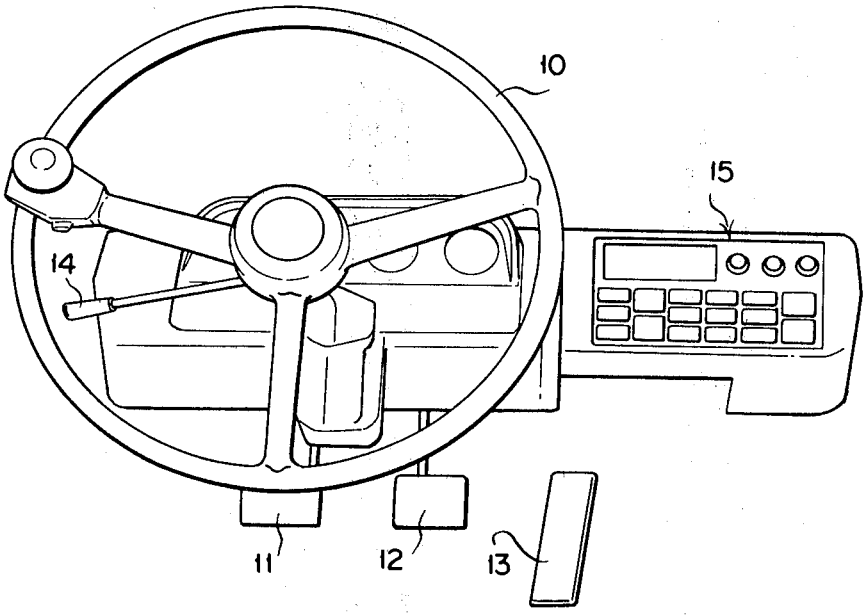
FIG. 2 is a view showing schematically how a control board of the present invention is arranged with respect to conventional steering wheel and pedals arrangements.
Figure 5:
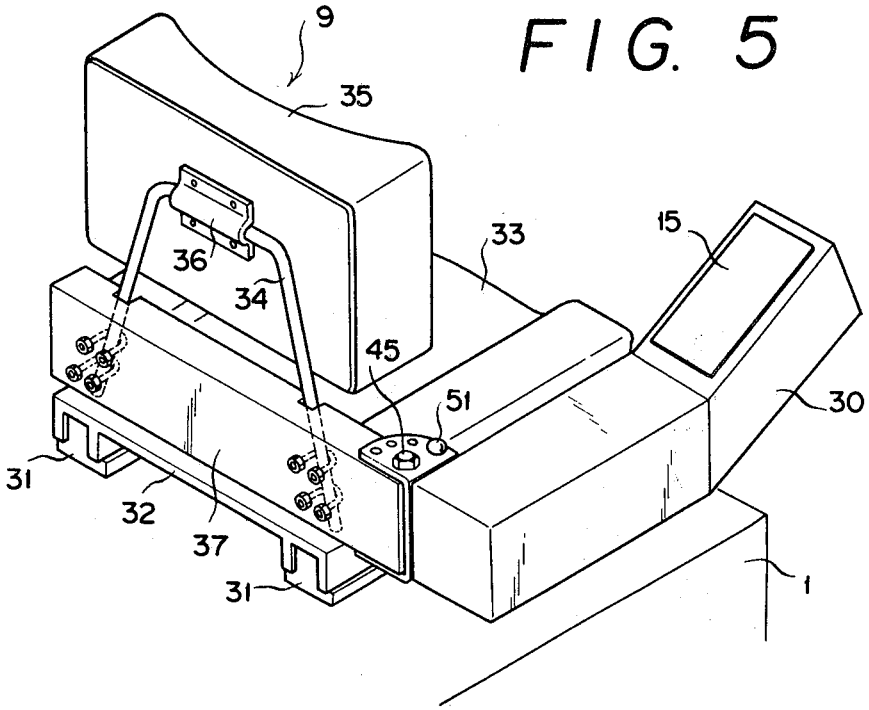
FIG. 5 is a perspective view showing how a control board is mounted to a driver's seat.

Although the control board 15 can be arranged in the dash-board of the truck as shown in FIG. 2, it can be more conveniently provided adjacent to the driver's seat 9 as shown in FIG. 5.

Figure 6:
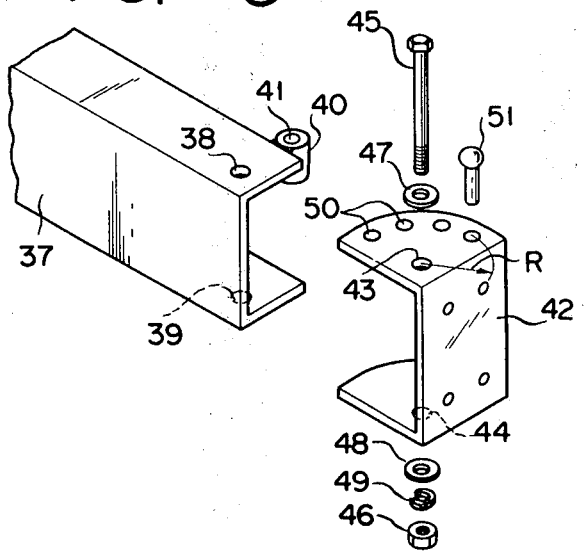
FIG. 6 is an enlarged exploded view showing mounting details of FIG. 5.
Figure 7:
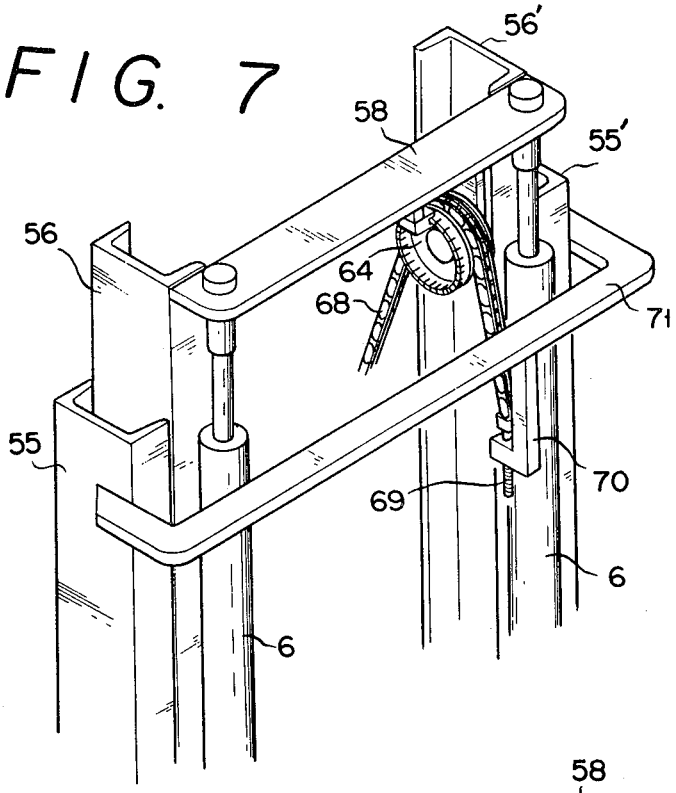
FIG. 7 is a perspective view showing schematically an upper part of a mast.

Referring to FIG. 5, the control board 15 is mounted on the upper surface of a control box 30 which accommodates the electronic controller therein. Fixedly mounted on the body 1 are a pair of guide rails 31, 31 on which a bottom frame structure 32 of the seat 9 is slidably mounted. The seat 9 comprises a seat cushion 33, an inverted U-shaped support rod 34, both lower ends of which are fixedly secured to the bottom frame structure 33, and a seat back 35 mounted to the support rod 34 through a bracket 36. C-shaped frame 37 is secured to the lower sections of the support rod 34 by means of U-shaped bolts. As is best shown in FIG. 6, the C-frame 37 has formed therein aligned holes 38 and 39 and a boss 40 welded to the frame 37. The boss 40 has a hole 41 formed therein. Although in FIG. 6 the control box 30 is detached from a bracket 42, it is bolted to the bracket 42 when assembled as shown in FIG. 5. The bracket 42 has formed therein aligned holes 43 and 44 through which a bolt 45 is inserted after aligning these holes with the holes 38 and 39 of the C-frame 37. The inserted bolt 45 can be tightened up by turning a nut 46 with suitable washers 47, 48 and 49 inserted therebetwween. The bracket 42 has also formed therein a plurality of holes 50, all of which are positioned on a quarter circle having a radius R from the center of the hole 43.

Since the hole 41 of the boss 40 is separated from the center of the hole 38 the same distance R, the bracket 42 can be secured to the C-frame 37 with varying angles by inserting a pin 51 into any one of the holes 50 selected and the hole 41 formed in the boss 40.

Therefore the operator can adjust the mounting angle of the control box 30 with respect to the C-frame 37 to obtain the best suited position of the control board 15.

Figure 8:
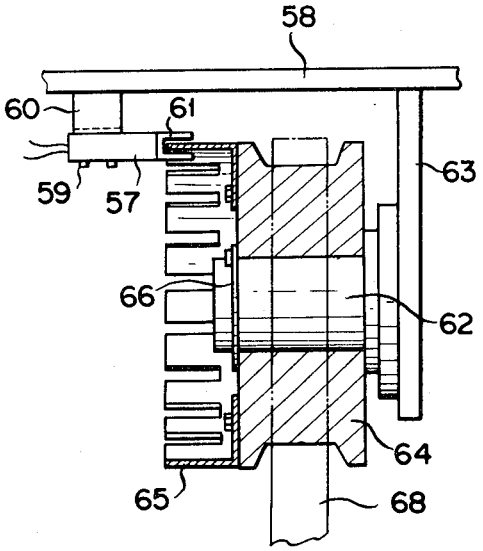
FIG. 8 is an enlarged front elevational view showing mounting arrangements of a fork-height sensor with respect to a roller of a drive chain.
Figure 9:
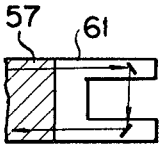
FIG. 9 is a further enlarged view showing a beam emitting portion of a fork-height sensor.

Referring to FIGS. 7 to 10, a fork height sensor mechanism will be explained. The mast 4 comprises a pair of outer rails 55, 55′ and a pair of inner rails 56, 56′. As best shown in FIG. 8, a fork height sensor 57 is secured to a stay 58 interconnecting the inner rails 56, 56′ by bolts 59 through a bracket 60. The fork height sensor 57 may, for example, comprises a photo-electric switch having a U-shaped beam emitting portion 61 formed at the leading end thereof. A shaft 62 is secured to a plate 63 which in turn is secured to the stay 58. A roller 64 is rotatably mounted on the shaft 62 and a circular slit plate 65 is bolted to a side face of the roller 64 in such a manner that the circular slit plate 65 passes in and through the U-shaped beam emitting portion 61 and therefore intermittently blocks the beam as the roller 64 rotates. Each slit space must be made the same throughout the entire circumference. A snap ring 66 prevents the roller 64 from being slipped off from the shaft 62.

Rod ends of a pair of lift cylinders 6, 6 are bolted to the stay 58. A chain 68 is wound around the roller 64 and one end of the chain 68 is connected by a bolt 69 to a stopper plate 70 which in turn is fixedly secured to a stay 71 interconnecting the outer rails 55, 55′.

The other end of the chain 68 is connected to a stopper portion (not shown) of the finger board 7. As the lift cylinders 6 extend or contract, the roller 64 rotates on the shaft 62 due to the frictional force between the roller 64 and the chain 68. Since the circular slit plate 65 is bolted to the roller 64, the former rotates together with the latter. As a result, the beam being continuously emitted from the beam emitting portion 61 is intermittently blocked by the circular slit plate 65 thereby producing ON/OFF pulse signals. These ON/OFF pulse signals are transmitted to the electronic controller and the height of the fork is detached by the number of pulses.

Figure 10:
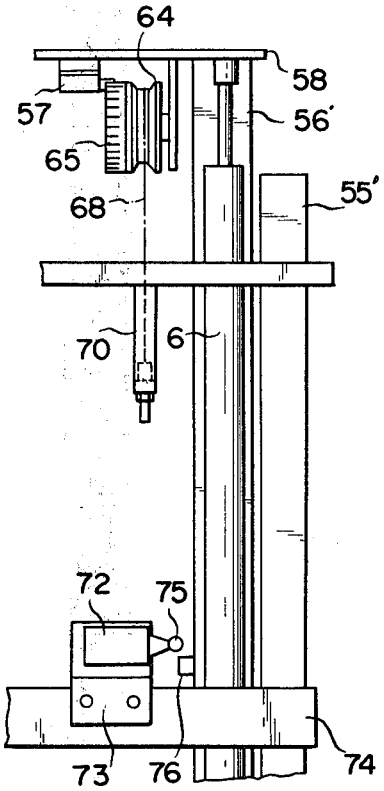
FIG. 10 is a front elevational view of a mast showing how a base height switch is mounted thereto.

Referring to FIG. 10, a base height switch 72 is mounted on a bracket 73 which in turn is bolted to a lower stay 74 interconnecting the outer rails 55 and 55'. A roller section 75 of the base height switch 72 is adapted to be pushed on and off by a cam plate 76 secured to the inner rail 56'. As the base height switch 72 is pushed on, a preselected base height $h_0$ is displayed on the display panel 23.

Figure 11:
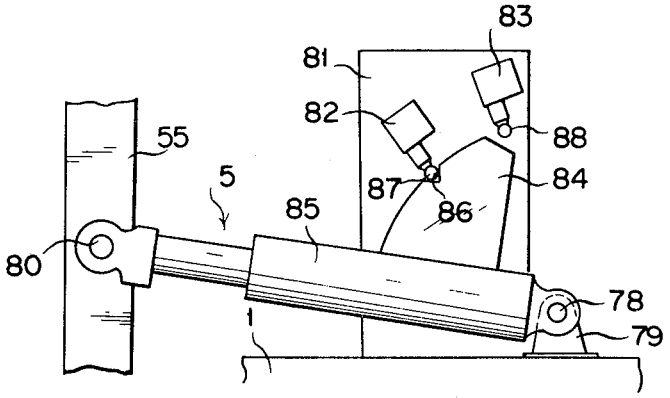
FIG. 11 is a side elevational view showing how tilt sensor limit switches are mounted with respect to a tilt cylinder.

Referring now to FIG. 11, mounting arrangements of a tilt position sensor mechanism will be explained. The tilt cylinder 5 has one end thereof pivotally connected by a pin 78 to a bracket 79 secured to the body 1 and other end thereof is pivotally connected by a pin 80 to the outer rail 55. Secured upright to the body 1 is a mounting plate 81 to which a limit switch 82 for detecting the upright posture of the mast 4 and another limit switch 83 for detecting a backwardly tilted posture of the mast 4 are mounted through brackets (not shown). An arc shaped cam plate 84 having its arc center at the pin 78 is secured to a barrel 85 of the tilt cylinder 5. The arc shaped cam plate 84 has formed therein a notch 86 and an upper right corner thereof is cut-off as shown so as to prevent the roller 88 from being pushed in by the cam plate 84 when the mast 4 is not fully tilted backwardly.

The limit switch 82 is mounted on the plate 81 in such a manner that the roller 87 thereof is adapted to be accommodated in the notch 86 and switched off when the mast 4 stands upright relative to the ground with no loads being imposed on the fork 8 while the limit switch 83 is mounted to the plate 81 in such a manner that the roller 88 thereof is adapted to be pushed in and therefore the limit switch 83 is switched on when the mast 4 is backwardly tilted to a preselected tilt angle.

Figure 12:
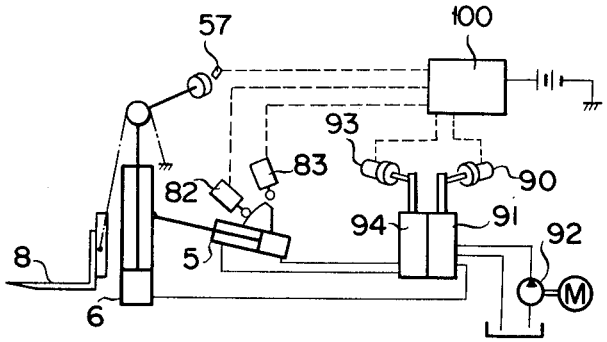
FIG. 12 is a view showing diagramatically how lift and tilt cylinders are controlled by an electronic controller according to the present invention.

Referring then to FIG. 12 showing diagrammatically an overall control circuit of the present invention, reference numeral 90 denotes an actuator for operating a lift valve 91 in response to an output signal from the electronic controller generally designated by reference numeral 100. The lift valve 91 when operated allows to supply fluid under pressure from a pump 92 to the lift cylinders 6 (only one is shown) thereby operating the same. Another actuator 93 is adapted to operate tilt valve 94 in response to a signal from the electronic controller 100. The tilt valve 94 when operated allows to supply fluid under pressure from the pump 92 to the tilt cylinder 5 thereby operating the same.

Figure 13:
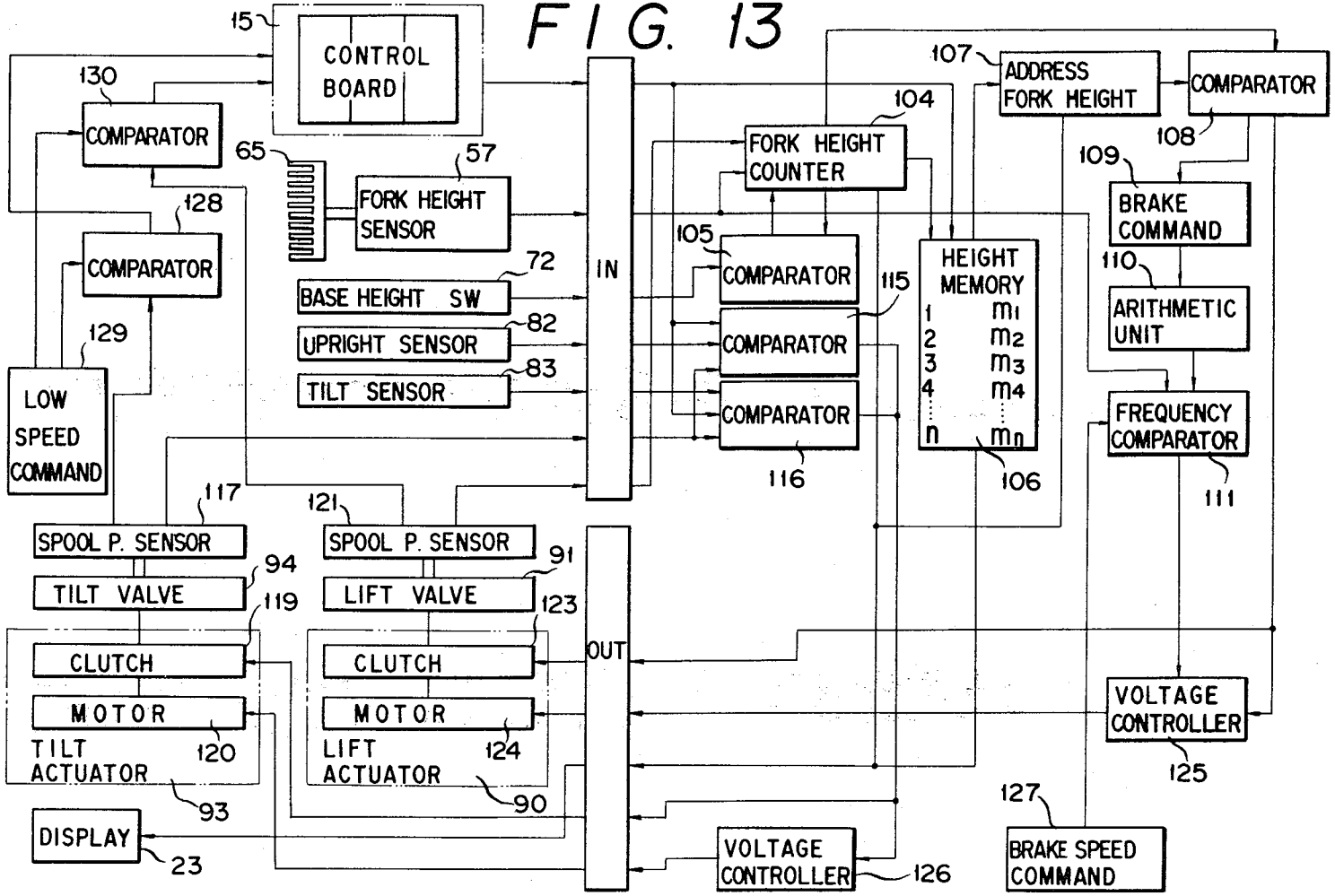
FIG. 13 is a block diagram of the electronic controller together with associated actuators according to the present invention.

The operation of the present invention will now be described in detail mainly with reference to FIG. 13 showing the electronic controller 100 in block diagrams.

When an engine key switch is turned on for starting the engine, the display panel 23 of the control board displays (0 0.00). When the switch 17 for raising the fork 8 is pushed on, a clutch 123 of the lift actuator 90 is engaged and voltage applied on a motor 124 is gradually increased by a voltage controller 125. As a consequence, the motor starts to rotate slowly before it picks up to its top speed thereby opening the lift valve 91 gradually which allows pressurized fluid supplied to the lift cylinders 6 to increase gradually.

Therefore the fork 8 is started to be raised gradually. During the upwards movement of the fork, the fork height sensor 57 detects the rotation of the circular slit plate 65 and generates ON/OFF pulse signals. These pulse signals are counted by a fork height counter 104 and current results of which are showed on the display panel 23 in digital fashion. While current fork height is continuously detected by the fork height sensor 57 and displayed on the display panel 23, in order to avoid detected fork height errors which may be caused by the slip between the roller 64 and the chain 68, the base height switch 72 is provided as shown in FIG. 10 in such a manner that when the cam plate 76 pushes the base height switch 72, the fork height is adjusted to a preselected base height, for example, 40 cm from the ground. Therefore whenever the base height switch 72 is pushed on by the up and down movements of the fork 8, current fork height being displayed on the display panel 23 is instantaneously corrected thereby. When the switch 17 for raising the fork is switched off after raising the fork 8 to a desired height, voltage applied on the motor 124 is not cut-off at once but is gradually decreased by the action of the voltage controller 125.

Therefore the lift valve 91 is gradually closed or moved toward the neutral position. And when a spool position sensor 121 detects the neutral position of the lift valve 91, the clutch 123 is disengaged and the fork 8 stops and is held there.

The automatic fork raising or lowering control according to the present invention will be described hereinbelow.

When it is required to raise the fork 8 to a preselected height repeatedly, the height can be memorized in a height memory 106. For example if the fork 8 is raised to a 90 cm by the manual operation set forth above and the operator wants to have memorized that the height in a fork height memory 106, the operator is required to push the storing switch 22 first and then any address switch among the address switch group 16.

If he pushes the address switch (1), the height memory 106 not only memorizes fork height 90 cm but also the address switch (1) pressed and the display panel 23 displays those data as (1 0.90).

Similarly if the operator wants to store a new fork height level such as 123 cm after the fork 8 is raised there by the manual operation, he pushes the switch 22 first and then address switch (2) among the address switch group 16. As a result, those data are stored in the height memory 106 and the display panel 23 displays those data as (2 1.23).

In this way the height memory can store several different fork heights and if the control board shown in FIG. 3 or FIG. 4 is used, nine different fork heights can be stored because those control boards include nine address switches, respectively. It is to be appreciated that the particular heights which are stored and read out from the memory and are used to control the movement of the fork need not be fixed but can be varied to suit the particular circumstances involved.

To effect the automatic fork raising or lowering control, one of the address switches 16 in the control board 15 is pushed. For example if the operator pushes button switch (2), the address number and address fork height are displayed on the display panel 23 as (2 1.23). Although the address fork height is shown as an independent block 107 from the height memory 106 in FIG. 13, the address fork height 107 indeed corresponds to one of the stored fork heights in the height memory 106. Therefore only for explanational convenience, the address fork height 107 is shown as an independent block. When the push button switch 19 is depressed, a comparator 108 compares signals from the fork height counter 104 with a signal from the address fork height 107 and generates a signal therefrom after judging whether the current fork height is above or below the addressed fork height. If the current fork height is below the addressed fork height, the comparator 108 sends out a signal to rotate the motor 124 in a direction to raise the fork 8 as well as to engage the clutch 123. To prevent the fork 8 from being suddenly raised and minimize the shock occuring thereby, voltage applied on the motor 124 is gradually increased to a constant voltage by controlling duty ratio by means of the voltage controller 125.

When the fork 8 passes through a preset height which is about 5 to 50 cm below the level of the addressed fork height in the case of fork raising operation, a brake speed command 127 sends out brake frequency signals to a frequency comparator 111. At the sme time a brake command 109 is actuated to detect current fork speed by counting ON/OFF pulses within a given time period and sends out signals to an arthmetic unit 110 where pulse signals are converted into frequency signals before being fed into the frequency comparator 111. The frequency comparator 111 compares both frequency signals from the arthmetic unit 110 and the brake speed command 127 and sends out a signal to the voltage controller 125 which is actuated thereby.

Therefore voltage applied on the motor 124 is gradually decreased thereby decreasing the fork speed.

And when the fork 8 is raised to the addressed fork height, the clutch 123 is disengaged and the fork 8 stops there without any shock. Mast tilting operation will be described hereinbelow. When the operator wants to move the mast 4 from a tilt-back position to the upright position, the push button switch 20 for tilting the mast 4 forwardly will be depressed. When the switch 20 is depressed a clutch 119 of the tilt actuator 93 is engaged and voltage applied on a motor 120 will be gradually increased by means of a voltage controller 126 thereby gradually increasing rotational speed of the motor 120. As a result, the tilt valve 94 is gradually opened to supply pressurized fluid to the tilt cylinder 5 thereby uprighting the mast 4 or tilting it forwardly from the tilt-back position. When the notch 86 of the cam plate 84 engages the roller 87 of the upright sensor or limit switch 82, the limit switch 82 is turned off and generates a signal. A comparator 115 compares the signal from the upright sensor 82 with that from the control board 15 and generates a signal to disengage the clutch 119 and bring the motor 120 to a halt. Accordingly, the mast 4 is moved to the upright position and held there. The tilting back operation of the mast 4 is similar to the tilting forward operation described above, therefore detailed descriptions thereof are omitted here.

The control board 15 has the high and low speeds change-over switch 26 as described hereinabove. When the switch 26 is changed over to low speed, a signal indicating a preset valve opening ratio from a low speed command 129 is fed into comparators 128 and 130. The comparators 128 and 130 compare the signal from the low speed command 129 with those from the spool position sensors 117 and 121, respectively, and when these signals correspond, the motor 120 and 124 are stopped but the clutches 119 and 123 are being kept engaged. Therefore the lift and tilt valves 91 and 94 are kept balanced at a preset valve opening rate. Accordingly, fork and mast moving speed can be controlled to a preset low speed. It is to be noted that the valve opening rate for low speed operation can be adjusted manually.

An automatic normal running posture operation will be described below. When the switch 25 for automatically bring the fork-lift truck to a normal running posture is depressed, the motor 124 is rotated to move the fork 8 to a preselected running level which is stored in the height memory 106 and also simultaneously or sequentially the motor 120 is rotated in a direction to tilt back the mast 4. When the tilt sensor 83 detects a predetermined tilt-back position, the clutch 119 is disengaged and the tilt valve 119 is brought back to the neutral position to stop the tilt back movement. Accordingly, the mast 4 and fork 8 are automatically brought to the normal running postures.

It should be noted that among various operational variations, manual operation has the first priority followed by the automatic running posture operation with the least priority being placed on the automatic fork raising and lowering operation. This means that when the automatic fork raising and lowering operation is being carried out, the operator can cut in to effect the manual operation overriding the automatic operation.

Although the present invention has been described with reference to preferred embodiments, numerous modifications and rearrangements could be made, and still the result would come within the scope of the invention.

What I claim is:

1. An electronic controller for controlling movements of a fork and a mast of a fork-lift truck wherein the movement of the fork is effected by a lifting mechanism and that of the mast is effected by a tilting mechanism, comprising:

first sensor means for detecting the movement of the fork and providing first signals denoting increments of that movement;

counter means for receiving said first signals and providing a count denoting the height of the fork along its range of movement;

memory means for storing data denoting the height of the fork and providing said stored data for comparison with said count;

means for effecting storage in said memory means;

first comparator means for comparing said count with the data from said memory means to provide a second signal for controlling the movement of the fork;

first actuator means adapted to receive said second signal and actuate said lifting mechanism in response thereto;

second sensor means for detecting an upright and a tilt-back position of the mast and providing a third signal to stop the mast movement;

second actuator means for actuating said tilt mechanism, said second actuator means being adapted to receive said third signal and to stop in response thereto;

base height switch means for providing a fourth signal indicating a predetermined base height whenever it is actuated by the fork;

second comparator means for comparing the count of said counter means with said fourth signal for correcting any errors of said count; and a control board means including a plurality of switches for starting and stopping the movements of the fork and the mast, said control board means being operable by a human operator to provide for the storage of said count in a storage location wherein the address is determined by the operation of a particular switch and wherein the memory is addressable on subsequent operation of said particular switch to provide the stored count to the first comparator means.

2. An electronic controller as recited in claim 1 further comprising a voltage controller coupled between said first comparator and said first actuator means for controlling the voltage applied to said first actuator means for gradually increasing or decreasing the voltage applied thereto.

3. A fork-lift truck including a truck body, a driver's seat, a mast pivotally mounted on the truck body, a tilt cylinder for effecting tilt movement of the mast, a fork mounted on the mast, and a lift cylinder for effecting up and down movements of the fork, comprising:

a control board mounted adjacent to said driver's seat, said control board having a plurality of push button switches thereon for controlling the movements of said fork and mast, and a display panel for displaying the height of said fork;

electronic controller means operatively connected with said control board for controlling the movements of said fork and mast, said controller means having memory means for storing data denoting a height of the fork;

fork height sensor means for detecting the movement of said fork and generating first signals denoting increments of the movement thereof, said fork height sensor means being operatively connected with said electronic controller means, wherein said fork height sensor means comprises a photoelectric switch having a U-shaped beam emitting portion formed at the leading end thereof, and a circular slit plate rotatable with the up and down movements of said fork, said circular slit plate being adapted to move in and through the U-shaped beam emitting portion thereby intermittently blocking the beam;

tilt sensor means mounted on said truck body for detecting an upright and a tilt-back position of said mast and providing a second signal to stop the mast movement;

first actuator means for actuating said lift cylinder, said first actuator means being connected with and controlled by said electronic controller means; and second actuator means for actuating said tilt cylinder, said second actuator being stopped upon receiving said second signal from said tilt sensor means.

4. A fork-lift truck as recited in claim 3 wherein said tilt sensor means comprises a pair of limit switches, one for detecting the upright position of the mast and the other for detecting the tilt-back position of the mast, and a cam plate mounted on said tilt cylinder, said cam plate being operatively associated with said limit switches.

5. A fork-lift truck as recited in claim 3 wherein said control board is mounted on a box-like arm pivotally mounted to said driver's seat and wherein said electronic controller means is housed within said box-like arm.

6. A fork-lift truck as recited in claim 3 wherein said control board is mounted in a dash-board of the truck.

7. A fork-lift truck as recited in claim 3, 5 or 6 wherein the plurality of push button switches of said control board comprise a plurality of address switches, fork raising and lowering switches, an automatic fork raising or lowering switch, a fork height data storing switch, and mast tilting switches each for forwardly or backwardly.

8. A fork-lift truck as recited in claim 7 wherein the push button switches further include a switch for changing high and low speeds and a switch for automatically bringing said fork and mast into a normal running postures.

* * * * *